US008514541B2

(12) United States Patent
Hatanaka et al.

(10) Patent No.: US 8,514,541 B2
(45) Date of Patent: Aug. 20, 2013

(54) INJECTOR DRIVE CIRCUIT

(75) Inventors: Ayumu Hatanaka, Tokai (JP); Akira Mishima, Mito (JP); Takuya Mayuzumi, Hitachinaka (JP); Mitsuhiko Watanabe, Odawara (JP); Fumiaki Nasu, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 379 days.

(21) Appl. No.: 13/034,151

(22) Filed: Feb. 24, 2011

(65) Prior Publication Data

US 2011/0220069 A1 Sep. 15, 2011

(30) Foreign Application Priority Data

Mar. 15, 2010 (JP) ..... 2010-057872

(51) Int. Cl.
*H01H 47/00* (2006.01)

(52) U.S. Cl.
USPC ..... 361/152; 361/189

(58) Field of Classification Search
USPC ..... 361/189, 152
See application file for complete search history.

(56) References Cited

U.S. PATENT DOCUMENTS 5,717,562 A * 2/1998 Antone et al. ..... 361/155
6,900,973 B2 5/2005 Tojo et al.
7,117,852 B2 * 10/2006 Santero et al. ..... 123/490
7,546,830 B2 * 6/2009 Nagase et al. ..... 123/490
7,621,259 B2 11/2009 Mayuzumi

FOREIGN PATENT DOCUMENTS

JP 2001-234793 8/2001
JP 2002-61534 A 2/2002
JP 2003-7530 A 1/2003
JP 2003-319699 A 11/2003
JP 2004-197629 A 7/2004
JP 2008-115848 A 5/2008
JP 2010-28878 A 2/2010

OTHER PUBLICATIONS

Japanese Office Action dated May 1, 2012 (three (3) pages).

* cited by examiner

*Primary Examiner* — Stephen W Jackson
(74) *Attorney, Agent, or Firm* — Crowell & Moring LLP

(57) ABSTRACT

The present invention realizes an injector drive circuit capable of providing high output power of a boost convertor while suppressing increases in size and cost thereof. An injector energizing circuit 200 includes an FET 2 which applies a high voltage 100*a* generated by a boost convertor 100 to an injection valve 20. The boost convertor 100 includes an input side capacitor 103, a boosting FET 105, a boost coil 104, a boost diode 106, and FETs 108 and 109 provided in association with a negative pole of an output side capacitor 107. During a period in which the high voltage 100*a* is applied to the injection valve 20, a gate signal 108*a* of the FET 108 is turned ON and a gate signal 109*a* of the FET 109 is turned OFF. Consequently, the boosting FET 105 performs a switching operation to turn OFF the gate signal 108*a* of the FET 108 and turn ON the gate signal 109*a* of the FET 109 during a period for charging into the output side capacitor 107. Thus, energy required for boosting can be reduced and an improvement in output is enabled.

6 Claims, 9 Drawing Sheets

INJECTOR DRIVE CIRCUIT

BACKGROUND OF THE INVENTION

1. Field of the Invention

The present invention relates to an injector drive circuit used in an automobile fuel injection device and the like.

2. Description of the Related Art

The practical application of a direct injection type gasoline engine that directly injects fuel into a cylinder of an automobile engine in which an injector drive circuit is used, is proceeding. The direct injection type gasoline engine has problems of a reduction in exhaust emission due to lean-burn and a reduction in fuel consumption rate in particular.

With this background, the driving of an injection valve needs to make faster the response time of the injection valve to an injection signal and control the injection valve proportionally from a range in which the time width of the injection signal is small. As means therefor, there has generally been known a method for applying a high voltage to the injection valve on the rising edge of the injection signal to cause a large current to flow therethrough thereby to shorten a valve open time, and thereafter controlling a holding current for holding the valve open.

Such a boost convertor as described in, for example, JP-2002-61534-A is required to generate a high voltage. One example of the performance of this boost convertor will be shown. That is, the boost convertor boosts a battery voltage from a battery voltage (14[V]) to 65[V] or so and supplies a peak current of 10 [A] or so. Further, when the maximum speed is taken as 6600 [rpm], for instance with a six-cylinder engine, the high voltage drives an injection valve for each time 3 [ms]. It is therefore necessary that the high voltage is returned to a predetermined value during 3 [ms] after the injection valve has been driven once. Further, the boost convertor assumes such specifications as to be capable of assuring the battery voltage up to 10[V].

Further, attention has been given to a technology called a multiple fuel injection for the purpose of low fuel consumption and a reduction in exhaust emission in the direct injection type gasoline engine. Multiple fuel injection means that fuel injected at a time relative to one stroke of a conventional piston is injected in several batches. The multiple fuel injection enhances combustion efficiency of gasoline and enables a reduction in NOx and the like.

SUMMARY OF THE INVENTION

The above multiple fuel injection involves an increase in the number of operations of a solenoid valve, thereby increasing a load on a boost convertor. This therefore requires an increase in the output power of the boost convertor.

The related art is however accompanied by increases in size and cost of the boost convertor in order to carry out the increase in the output power of the boost convertor.

An object of the present invention is to realize an injector drive circuit that enables an increase in the output power of a boost convertor while suppressing increases in size and cost thereof.

In order to solve the above problems, the present invention is configured as follows.

An injector drive circuit of the present invention comprises an input side capacitor to which a voltage of a battery is applied, a boost coil having one end coupled to a positive pole of the input side capacitor, a first switch element coupled to the other end of the boost coil, an output side capacitor coupled to the other end of the boost coil, a second switch element coupled to a positive pole of the output side capacitor, an injection valve coupled to the second switch element, a third switch element coupled between a negative pole of the output side capacitor and the positive pole of the input side capacitor, a fourth switch element coupled between the negative pole of the output side capacitor and a negative pole of the input side capacitor, a first opening/closing command signal generating unit for supplying an opening/closing command signal to the first switch element, the third switch element and the fourth switch element, and a second opening/closing command signal generating unit for supplying an opening/closing command signal to the second switch element.

According to the present invention, an injector drive circuit can be achieved which enables an increase in the output power of a boost convertor while suppressing increases in size and cost thereof.

DESCRIPTION OF THE PREFERRED EMBODIMENTS

Preferred embodiments of the present invention will be hereinafter described with reference to the accompanying drawings.

First Embodiment

A first embodiment of the present invention will be explained in detail.

Figure 1:
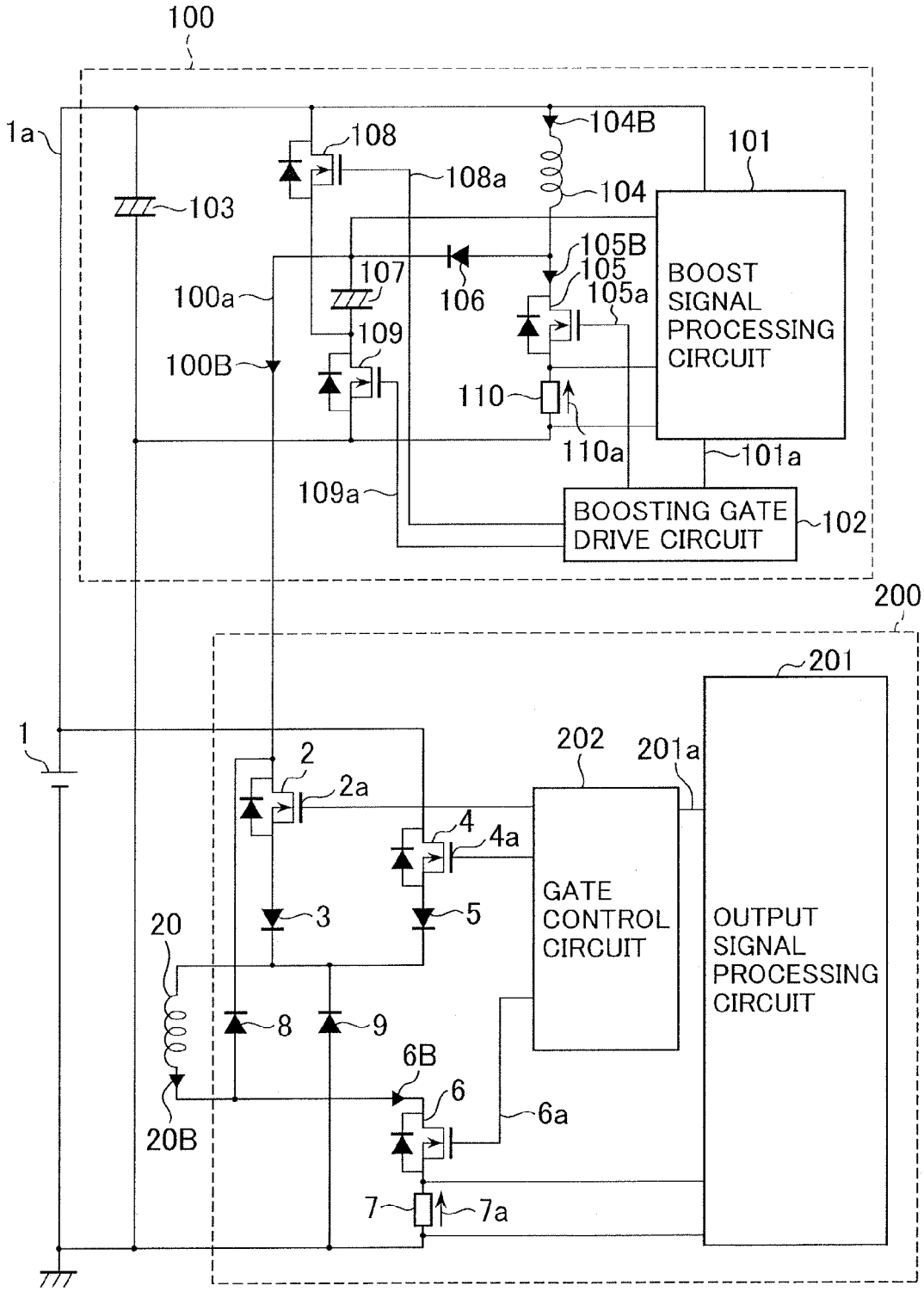
FIG. 1 is a circuit diagram of an injector drive circuit according to a first embodiment.

FIG. 1 is a circuit configuration diagram of an injector drive circuit according to a first embodiment of the present invention, and shows a circuit corresponding to one cylinder of an injection valve of a multi-cylinder engine of an automobile fuel injection device.

In FIG. 1, the injector drive circuit is provided with a boost convertor 100 which is connected to a battery 1 and generates a high voltage 100*a* from a battery voltage 1*a*, and an injector energizing circuit 200 which causes an injector drive current 20B to pass through an injection valve 20.

The boost convertor 100 is provided with an input side capacitor 103 charged by the battery voltage 1*a*, a boost coil 104, a boost FET 105 (first switch element), a resistor 110 for detection of a current 105B flowing through the boost FET 105, an output side capacitor 107 in which the high voltage 100*a* is charged, a diode 106 (rectifying element) for energizing the output side capacitor 107, an FET 108 (third switch element) for biasing the negative pole of the output side capacitor 107 by the battery voltage 1*a*, an FET 109 (fourth switch element) for earthing the negative pole of the output side capacitor 107, a boost signal processing circuit 101 for generating a boost signal 101*a*, based on the battery voltage 1*a* to be detected, high voltage 100*a* and voltage 110*a* developed across the resistor 110, and a boosting gate drive circuit 102 (first opening/closing command signal generating unit) for generating gate signals 105*a*, 108*a* and 109*a*, based on the boost signal 101*a* to be supplied thereto, i.e., the voltage applied across the input side capacitor 103 and the voltage applied across the output side capacitor 107.

The injector energizing circuit 200 is provided with an FET 2 (second switch element) for applying the high voltage 100*a* to the injection valve 20, a diode 3 for blocking a reverse current flow into the FET 2, an FET 4 for applying the battery voltage 1*a* to the injection valve 20, a diode 5 for blocking a reverse current flow into the FET 4, a relay FET 6 of the injector current 20B, a resistor 7 for detecting a current 6B flowing through the FET 6, a diode 9 for causing the injector current 20B to reflow or flow back, a diode 8 for regenerating the injector current 20B to the output side capacitor 107 at the time of cutoff of the FET 6, an output signal processing circuit 201 for generating an injection signal 201*a* for driving the injection valve 20, and a gate control circuit 202 (second opening/closing command signal generating unit) for generating gate signals 2*a*, 4*a* and 6*a*, based on the injection signal 201*a* to be supplied.

The operation of the injector drive circuit configured as described above will be explained below.

Figure 2:
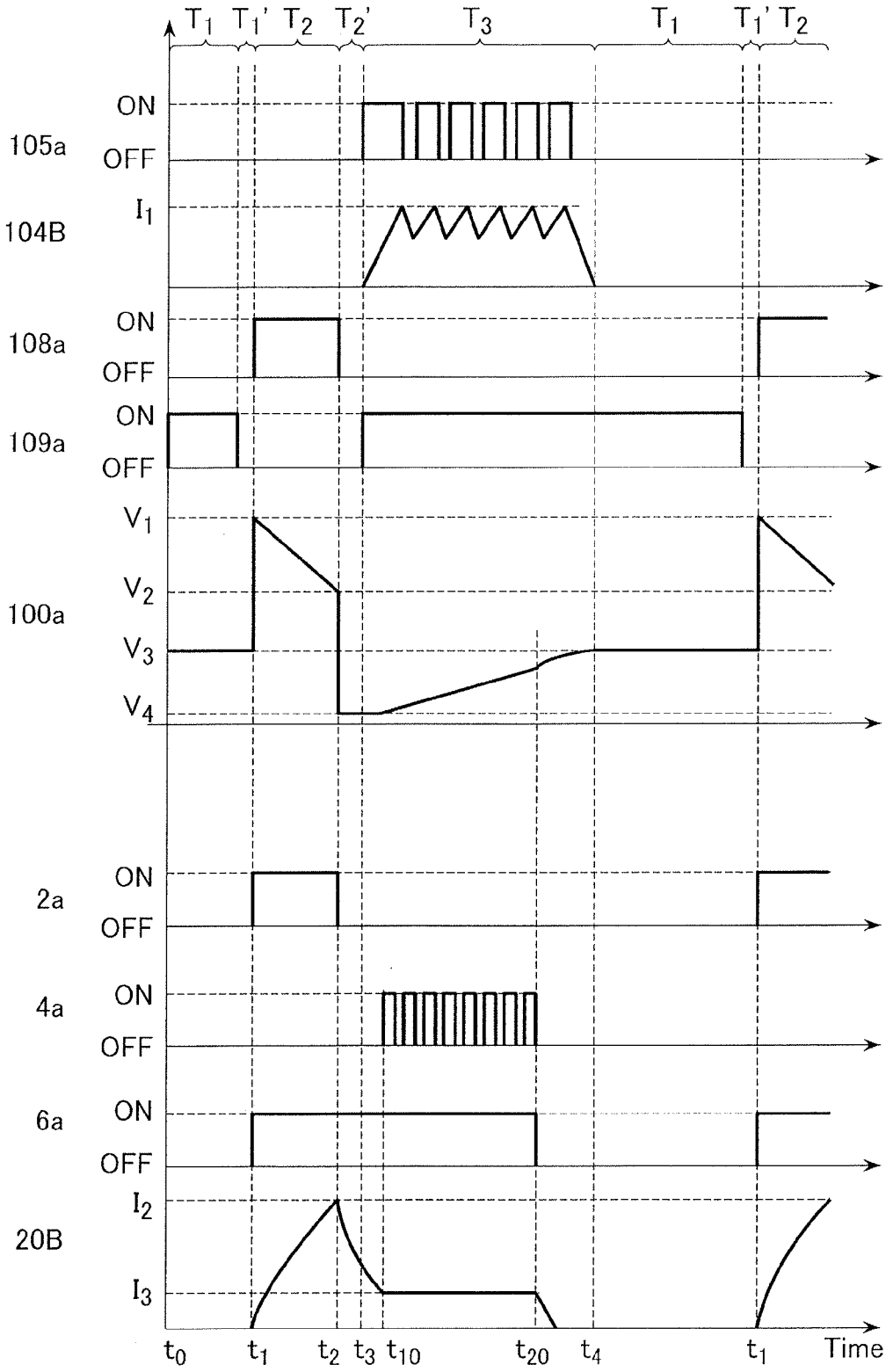
FIG. 2 is a diagram showing current-voltage and element signal waveforms according to the first embodiment.

FIG. 2 shows waveforms of the gate signals 2*a*, 4*a*, 6*a*, 105*a*, 108*a* and 109*a*, boost coil current 104B, injector current 20B, and output side capacitor voltage 100*a* employed in the first embodiment. In FIG. 2, the voltage is expressed as $V_N$ below, and the difference in type between the voltages is represented according to the difference between numerals placed in subscripts N.

At a timing $t_0$ of a Vb bias release period $T_1$, the gate signal 108*a* is turned OFF, the gate signal 109*a* is turned ON and the output side capacitor voltage 100*a* is maintained at a voltage $V_3$ obtained by subtracting the battery voltage 1*a* from a target voltage $V_1$ at the opening of the injection valve.

During a battery short-circuit prevention period $T_1'$, the boosting gate drive circuit 102 turns OFF the gate signals 108*a* and 109*a* to prevent the battery 1 from being short-circuited. At this time, the boost signal processing circuit 101 supplies the boost signal 101*a* corresponding to a command signal for opening and closing the switching elements 105, 108 and 109 to the boosting gate drive circuit 102, based on both detected voltages across both capacitors 103 and 107.

At a timing $t_1$ of a Vb bias period $T_2$, the gate signal 108*a* is turned ON, the gate signal 109*a* is turned OFF, and the negative pole of the output side capacitor 107 is biased by the battery voltage 1*a* because the gate signal 108*a* is held ON. Therefore, the output side capacitor voltage 100*a* reaches the valve opening target voltage $V_1$ of the injection valve 20. Further, the gate signals 2*a* and 6*a* are turned ON, so that the high voltage $V_1$ is applied to the injection valve 20.

At a timing $t_2$ of the Vb bias period $T_2$, the injector current 20B reaches a valve opening current $I_2$ and the gate signal 2*a* is turned OFF. The output side capacitor voltage 100*a* drops to $V_2$ due to energization to the injection valve 20.

The injector current 20B is caused to reflow through the diode 9 and becomes a valve opening holding current $I_3$ at a timing $t_{10}$). During a period from the timing $t_{10}$ to the timing $t_{20}$, a PWM signal is applied to the gate signal 4*a* and a PWM voltage of the battery voltage 1*a* is applied to the injection valve 20 to hold the valve opening holding current $I_3$. At the timing $t_{20}$, the gate signals 4*a* and 6*a* are turned OFF, and the injector current $I_3$ is charged into the output side capacitor 107 via the diode 8.

During a battery short-circuit prevention period $T_2'$, the boosting gate drive circuit 102 turns OFF the gate signals 108*a* and 109*a* to prevent the battery 1 from being short-circuited.

Next, at a timing $t_3$ of a boost period $T_3$ in a Vb bias release period, the gate signal 108*a* is turned OFF and the gate signal 109*a* is turned ON, so that the negative pole of the output side capacitor 107 is earthed. Thus, the output side capacitor voltage 100*a* drops to a voltage $V_4$ obtained by subtracting the battery voltage 1*a* from $V_2$.

During the boost period $T_3$ in the Vb bias release period, the gate signal 108*a* is turned OFF and the gate signal 109*a* is turned ON, so that a PWM operation signal is applied to the FET 105 like the gate signal 105*a*. Thus, the boost current 104B is allowed to pass through the boost coil 104 so as not to exceed an upper limit current $I_1$, whereby the boost current 104B is charged into the output side capacitor 107.

At a timing $t_4$ of the boost period $T_3$ in the Vb bias release period, the gate signal 108*a* is turned OFF and the gate signal 109*a* is turned ON. Thus, the output side capacitor voltage 100*a* reaches the voltage $V_3$ obtained by subtracting the battery voltage 1*a* from the target voltage $V_1$ at the opening of the injection valve, and the gate signal 105*a* is turned OFF.

The boosting gate drive circuit 102 has a function of preventing the FETs 108 and 109 from being turned ON (closed) simultaneously.

Figure 3:
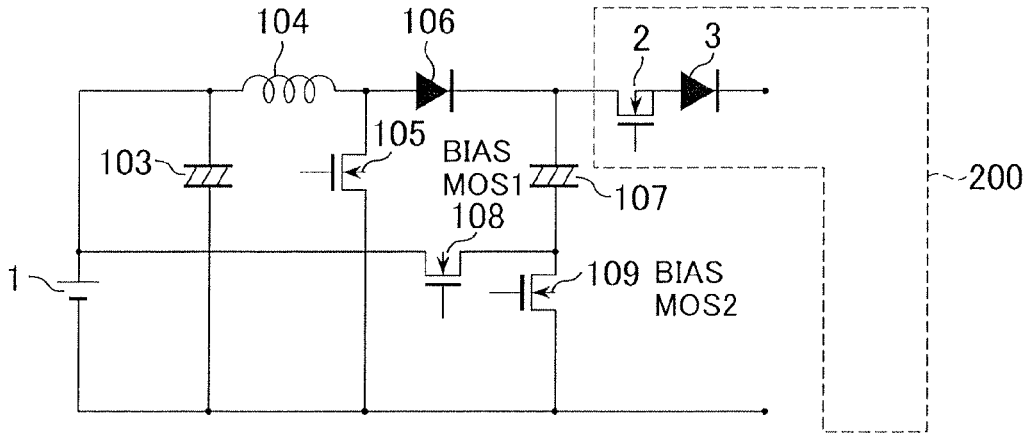
FIG. 3 is an explanatory diagram showing main parts of the injector drive circuit according to the first embodiment.
Figure 4:
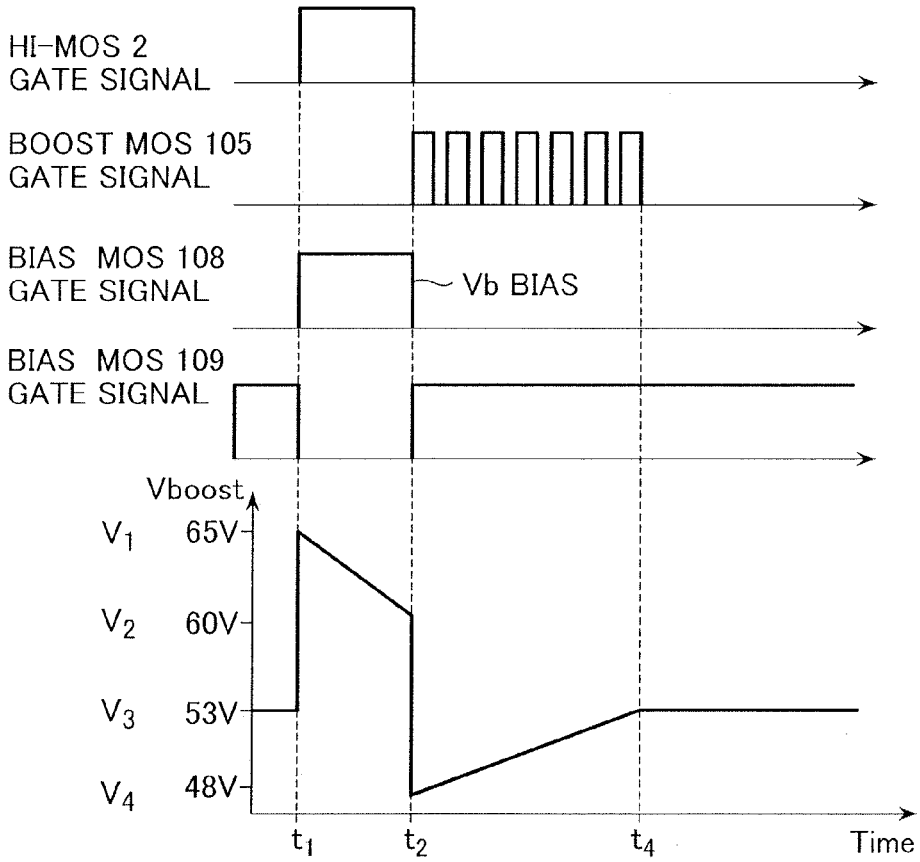
FIG. 4 is an explanatory diagram showing a signal waveform of the main parts according to the first embodiment.

FIG. 3 is a circuit diagram of main parts of the injector drive circuit according to the first embodiment, and FIG. 4 is a signal waveform diagram for the circuit diagram of the main parts shown in FIG. 3.

Figure 5:
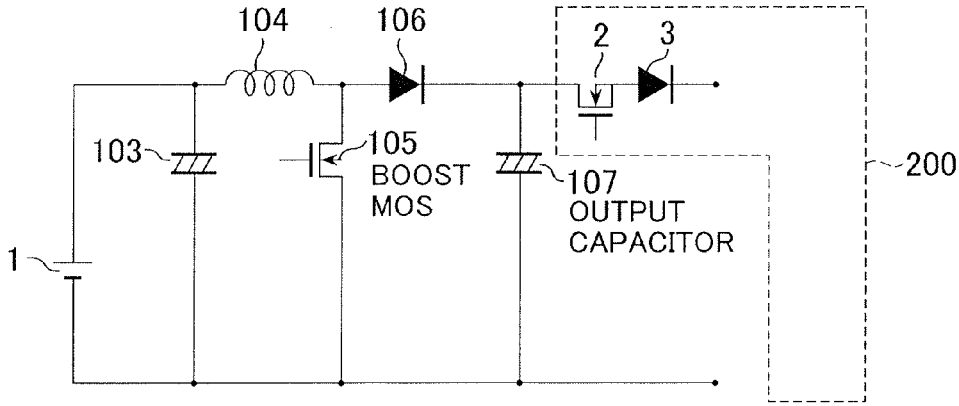
FIG. 5 is an explanatory diagram showing a circuit configuration of a drive circuit that has adopted a system different from that of the present embodiment.
Figure 6:
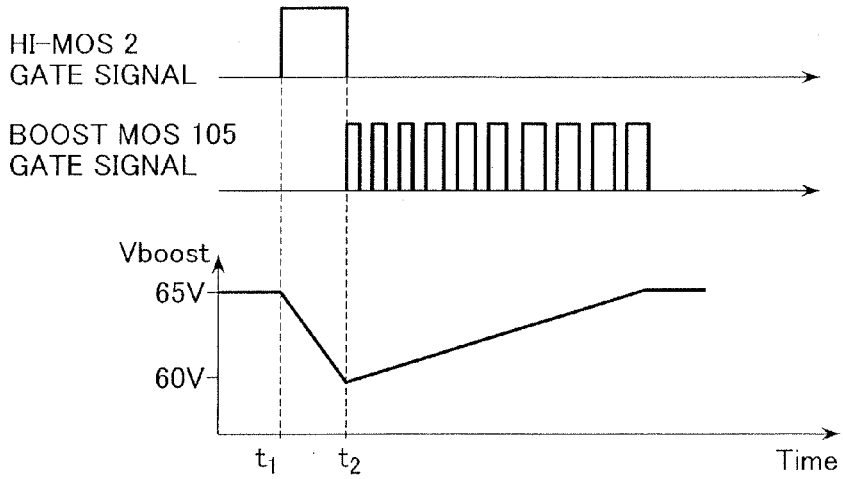
FIG. 6 is an explanatory diagram showing a signal waveform of the example shown in FIG. 5.

FIG. 5 is a circuit diagram of main parts of an injector drive circuit using another system different from that of the present embodiment, and FIG. 6 is a signal waveform diagram for the circuit diagram of the main parts shown in FIG. 5.

In FIG. 5, an input side capacitor 103 is coupled in parallel to a battery 1. One end of a boost coil 104 is coupled to the anode side of the battery 1 and one end of the input side capacitor 103. The other end of the boost coil 104 is coupled to the cathode or negative pole side of the battery 1 and the other end of the input side capacitor 103 through a boost MOSFET 105.

The other end of the boost coil 104 is coupled to one end of an output side capacitor 107 via a diode 106. The other end of the output side capacitor 107 is coupled to the negative pole side of the battery 1.

One end of the output side capacitor 107 is coupled to a diode 3 through an FET 2 of an injector energizing circuit 200. Illustrations and explanations of other portions of the injector energizing circuit 200 are omitted.

At a timing $t_1$ of FIG. 6, a boost voltage Vboost of the output side capacitor 107 is reduced from 65[V] and becomes 60[V] at a timing $t_2$. Then, the boost voltage Vboost is boosted or stepped up from the timing $t_2$, and rises from the voltage 60[V] to 65[V].

In contrast, in the first embodiment shown in FIG. 3, the other end of the output side capacitor 107 is coupled to the negative pole side of the battery 1 through a bias MOSFET 109. Further, the positive pole side of the battery 1 is coupled to a connection point of the output side capacitor 107 and the bias MOSFET 109 via a bias MOSFET 108.

Other configurations are similar to the example illustrated in FIG. 5.

As shown in FIGS. 3 and 4, the boost voltage Vboost of the output side capacitor 107 is reduced from 65[V] to 48[V] during a period from a timing $t_1$ to a timing $t_2$ by switching operations of the bias MOSFETs 108 and 109. The boost voltage Vboost rises from 48[V] to 53[V] during a period from the timing $t_2$ to a timing $t_4$, and is maintained at 53[V].

Assume now that the target voltage $V_1$=65[V], the battery voltage 1*a*=12[V] and the voltage drop developed due to the energization to the injection valve 20 is 5[V], the boost voltages $V_1$, $V_2$, $V_3$ and $V_4$ become $V_1$=65[V], $V_2$=60[V], $V_3$=53[V] and $V_4$=48[V].

When a voltage corresponding to the voltage drop due to the energization to the injection valve 20 is charged by the example shown in FIG. 5, the output side capacitor 107 (300 [μF]) is boosted from $V_2$=60[V] to $V_1$=65[V]. Thus, charging energy $(1/2\cdot(C)(65^2-60^2))$ becomes about 0.094 [J].

In contrast, in the first embodiment, the output side capacitor (300 [μF]) is boosted from $V_4$=48[V] to $V_3$=53[V], and hence charging energy $(1/2\cdot(C)(53^2-48^2))$ becomes about 0.076 [J].

Comparing the above charging energies, the first embodiment enables an about 19% reduction in charging energy as compared with the system of FIG. 5. Accordingly, a load on the boost convertor is reduced.

The shortening of boost time is enabled.

The two bias MOSFETs 108 and 109 have been additionally provided in the first embodiment of the present invention. Since, no boost voltage Vboost is, however, applied to these bias MOSFETs 108 and 109, inexpensive low-breakdown voltage MOSFETs can be used and the cost of a radiating member or the like of a control unit including an injector drive circuit can be reduced.

The low-breakdown voltage MOSFETs 108 and 109 are low in ON resistance. Further, as shown in FIG. 2, a steady loss and a switching loss are low because the number of times that switching is performed is also small. It is possible to supply a stable high voltage to the injection valve.

Thus, according to the first embodiment, an injector drive circuit can be realized which enables an increase in the output power of a boost convertor while suppressing increases in size and cost thereof.

Second Embodiment

A second embodiment of the present invention will next be explained.

The second embodiment is similar in circuit configuration to the circuit shown in FIG. 1, but different in signal waveform from each other.

Figure 7:
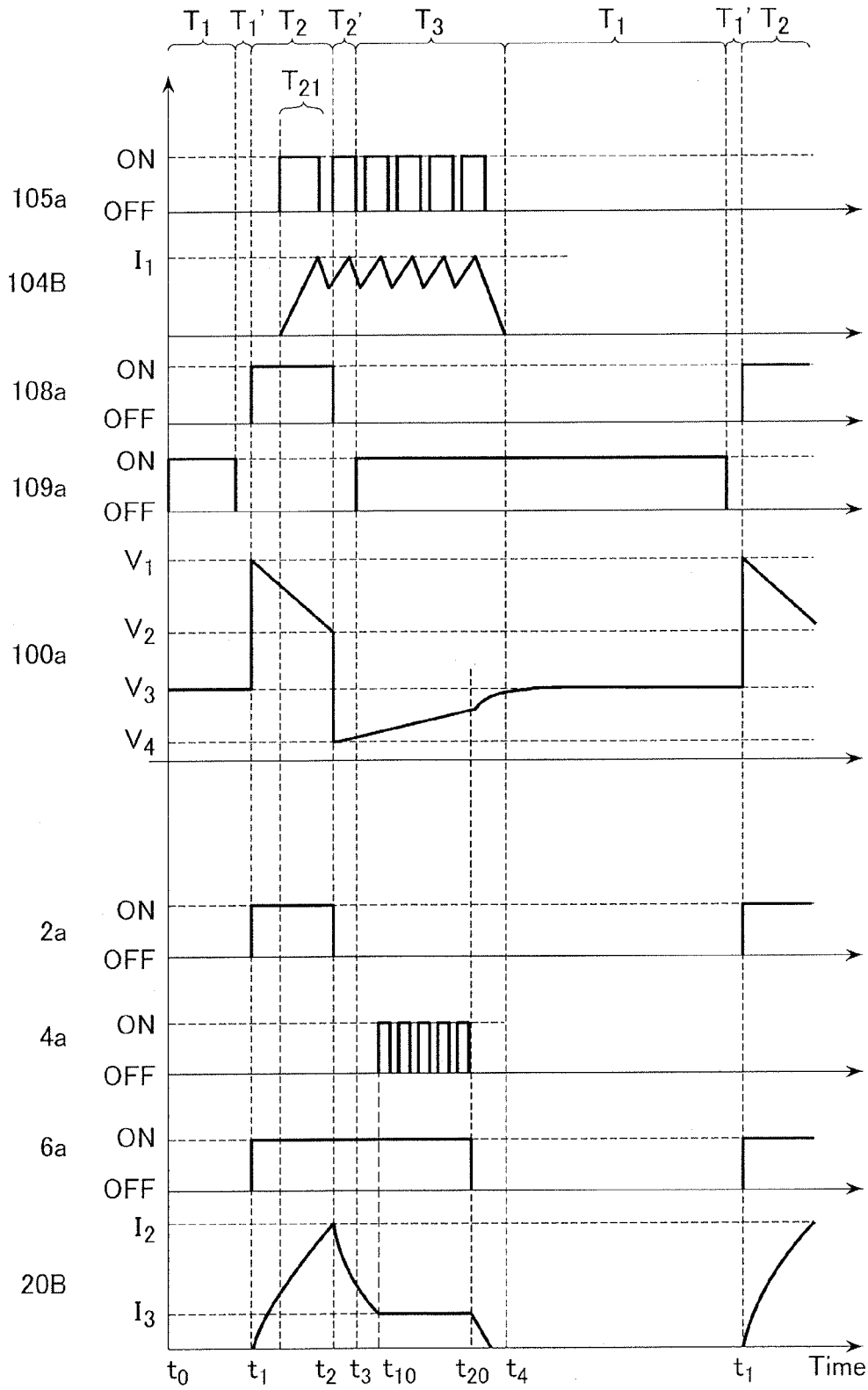
FIG. 7 is a diagram showing current-voltage and element signal waveforms of an injector drive circuit according to a second embodiment.

FIG. 7 is a signal voltage-current waveform diagram of the second embodiment.

In FIG. 7, at a timing $t_0$ of a Vb bias release period $T_1$, a gate signal 108*a* is turned OFF, a gate signal 109*a* is turned ON, and an output side capacitor voltage 100*a* is maintained at a voltage $V_3$ obtained by subtracting a battery voltage 1*a* from a target voltage $V_1$ at the opening of an injection valve.

During a battery short-circuit prevention period $T_1'$, a boosting gate drive circuit 102 turns OFF the gate signals 108*a* and 109*a* to prevent a battery from being short-circuited.

At a timing $t_1$ of a Vb bias period $T_2$, the gate signal 108*a* is turned ON, the gate signal 109*a* is turned OFF, and the negative pole of an output side capacitor 107 is biased by the battery voltage 1*a*. Therefore, the output side capacitor voltage 100*a* reaches the valve opening target voltage $V_1$ of the injection valve. Further, gate signals 2*a* and 6*a* are turned ON, so that the high voltage $V_1$ is applied to the injection valve.

At a timing $t_2$ of the Vb bias period $T_2$, an injector current 20B reaches a valve opening current $I_2$ and the gate signal 2*a* is turned OFF. The output side capacitor voltage 100*a* drops to $V_2$ due to energization to the injection valve.

The injector current 20B is caused to reflow through a diode 9, and becomes a valve opening holding current I3 at a timing $t_{10}$. During a period from the timing $t_{10}$ to the timing $t_{20}$, a PWM signal is applied to a gate signal 4*a* and a PWM voltage of the battery voltage 1*a* is applied to the injection valve to hold the valve opening holding current $I_3$. At the timing $t_{20}$, the gate signals 4*a* and 6*a* are turned OFF, so that the injector current $I_3$ is charged into the output side capacitor 107 via a diode 8.

During a boost period $T_{21}$ in the Vb bias period $T_2$, the gate signal 108*a* is turned ON and the gate signal 109*a* is turned OFF, so that a PWM operation signal is applied to an FET 105 like a gate signal 105*a*. Thus, a boost current 104B is allowed to pass through a boost coil 104 so as not to exceed an upper limit current $I_1$, whereby the boost current 104B is charged into the output side capacitor 107. Therefore, reduction in the output side capacitor voltage 100*a* becomes gentle during the boost period $T_{21}$.

During a battery short-circuit prevention period $T_2'$, the boosting gate drive circuit 102 turns OFF the gate signals 108*a* and 109*a* to prevent the battery from being short-circuited.

At a timing $t_3$ of a boost period $T_3$ in a Vb bias release period, the gate signal 108*a* is turned OFF and the gate signal 109*a* is turned ON, so that the negative pole of the output side capacitor 107 is earthed. Thus, the output side capacitor voltage 100*a* drops to a voltage $V_4$ obtained by subtracting the battery voltage 1*a* from $V_2$.

During the boost period $T_3$ in the Vb bias release period, the gate signal 108*a* is turned OFF and the gate signal 109*a* is turned ON, so that a PWM operation signal is applied to the FET 105 like the gate signal 105*a*. Thus, the boost current 104B is allowed to pass through the boost coil 104 so as not to exceed the upper limit current $I_1$, whereby the boost current 104B is charged into the output side capacitor 107.

At a timing $t_4$ of the boost period $T_3$ in the Vb bias release period, the gate signal 108*a* is turned OFF and the gate signal 109*a* is turned ON. Thus, the output side capacitor voltage 100*a* reaches the voltage $V_3$ obtained by subtracting the battery voltage 1*a* from the target voltage $V_1$ at the opening of the injection valve, and the gate signal 105*a* is turned OFF.

Assume now that the target voltage $V_1$=65[V], the battery voltage 1*a*=12[V] and the voltage drop which is developed across the output side capacitor 100*a* lying during the injector energization period due to the charge in the boost period $T_{21}$ in the second embodiment is 4[V] (value smaller than the voltage drop in the first embodiment by 1[V]), $V_1$, $V_2$, $V_3$ and $V_4$ become $V_1$=65[V], $V_2$=61[V], $V_3$=53[V] and $V_4$=49[V].

When a voltage corresponding to the voltage drop developed during the injector energization period is charged by the example shown in FIG. 5, not according to the second embodiment, the output side capacitor (300 [μF]) is boosted from $V_2$=61[V] to $V_1$=65[V]. As a result, the charging energy becomes about 0.0756 [J].

In contrast, in the second embodiment, the output side capacitor (300 [μF]) is boosted from $V_3$=49[V] to $V_4$=53[V] and hence charging energy becomes about 0.0612 [J].

When the charging energy in the boost period $T_{21}$ is assumed to be about 0.0182 [J] upon charging from 60[V] to 61[V], and 0.0182 [J] is identically added to both the case of charging in the second embodiment and the case of charging not according to the second embodiment, the present embodiment enables an about 15% reduction in the charging energy as compared with other systems.

While the rate of reduction in the charging energy in the second embodiment becomes smaller than that in the first embodiment, the boost period $T_3$ in the Vb bias release period can be shortened as compared with the first embodiment due to the charging from the injector energization period.

In addition to the above, advantageous effects similar to those in the first embodiment can be obtained even in the second embodiment.

Third Embodiment

A third embodiment of the present invention will next be described.

Figure 8:
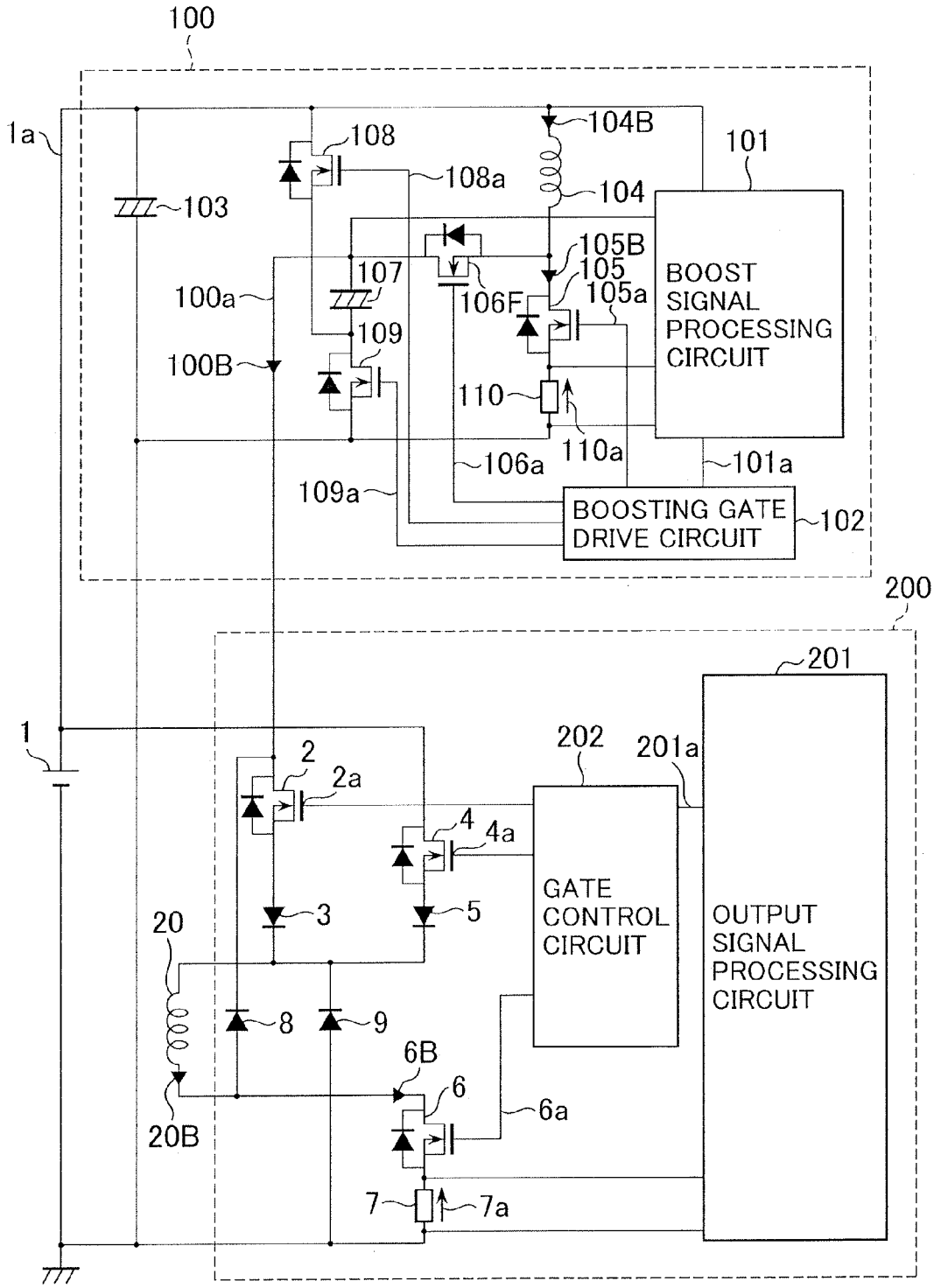
FIG. 8 is a circuit diagram of an injector drive circuit according to a third embodiment.

FIG. 8 is a circuit configuration diagram of an injector drive circuit according to the third embodiment and shows a circuit corresponding to one cylinder of an injection valve of a multi-cylinder engine.

In FIG. 8, an FET 106F is coupled instead of the diode 106 shown in FIG. 1, and a gate signal 106*a* is supplied from a boosting gate drive circuit 102 to the gate of the FET 106F. The FET 106F has a body diode thereinside.

The example shown in FIG. 8 is similar to the example shown in FIG. 1 in other circuit configuration.

Figure 9:
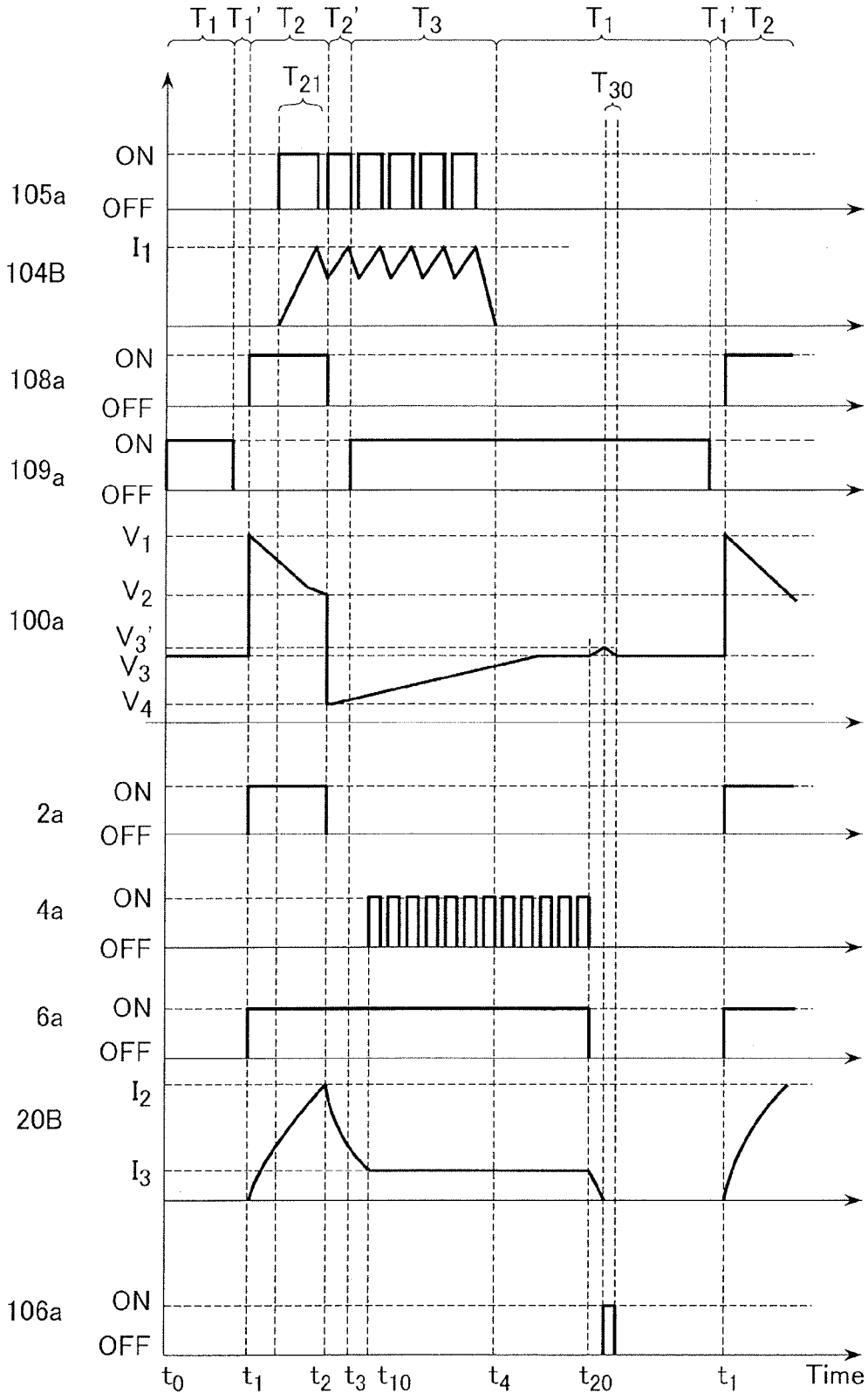
FIG. 9 is a diagram showing current-voltage and element signal waveforms according to the third embodiment.

The operation of the injector drive circuit according to the third embodiment will next be explained. FIG. 9 is a diagram showing waveforms of gate signals 2*a*, 4*a*, 6*a*, 105*a*, 106*a*, 108*a* and 109*a*, a boost coil current 104B, an injector current 20B and an output side capacitor voltage 100*a* employed in the third embodiment.

At a timing $t_0$ of a Vb bias release period $T_1$, the gate signal 108*a* is turned OFF, the gate signal 109*a* is turned ON and the output side capacitor voltage 100*a* is maintained at a voltage $V_3$ obtained by subtracting a battery voltage 1*a* from a target voltage $V_1$ at the opening of an injection valve.

During a battery short-circuit prevention period $T_1'$, the boosting gate drive circuit 102 turns OFF the gate signals 108*a* and 109*a* to prevent a battery from being short-circuited.

At a timing $t_1$ of a Vb bias period $T_2$, the gate signal 108*a* is turned ON, the gate signal 109*a* is turned OFF, and the negative pole of an output side capacitor 107 is biased by the battery voltage 1*a*. Therefore, the output side capacitor voltage 100*a* reaches the valve opening target voltage $V_1$ of the injection valve. Further, the gate signals 2*a* and 6*a* are turned ON, so that the high voltage $V_1$ is applied to the injection valve.

At a timing $t_2$ of the Vb bias period $T_2$, the injector current 20B reaches a valve opening current $I_2$ and the gate signal 2*a* is turned OFF. The output side capacitor voltage 100*a* drops to $V_2$ due to energization to the injection valve.

The injector current 20B is caused to reflow through a diode 9, and becomes a valve opening holding current $I_3$ at a timing $t_{10}$. During a period from the timing $t_{10}$ to the timing $t_{20}$, a PWM signal is applied to the gate signal 4*a* and a PWM voltage of the battery voltage 1*a* is applied to the injection valve to hold the valve opening holding current $I_3$.

During a boost period $T_{21}$ in the Vb bias period $T_2$, the gate signal 108*a* is turned ON and the gate signal 109*a* is turned OFF, so that a PWM operation signal is applied to an FET 105 like the gate signal 105*a*. Thus, the boost current 104B is allowed to pass through a boost coil 104 so as not to exceed an upper limit current $I_1$, whereby the boost current 104B is charged into the output side capacitor 107. Therefore, a reduction in the output side capacitor voltage 100*a* becomes gentle during the boost period $T_{21}$.

During a battery short-circuit prevention period $T_2'$, the boosting gate drive circuit 102 turns OFF the gate signals 108*a* and 109*a* to prevent the battery from being short-circuited.

At a timing $t_3$ of a boost period $T_3$ in a Vb bias release period, the gate signal 108*a* is turned OFF and the gate signal 109*a* is turned ON, so that the negative pole of the output side capacitor 107 is earthed. Thus, the output side capacitor voltage 100*a* drops to a voltage $V_4$ obtained by subtracting the battery voltage 1*a* from $V_2$.

During the boost period $T_3$ in the Vb bias release period, the gate signal 108*a* is turned OFF and the gate signal 109*a* is turned ON, so that a PWM operation signal is applied to the FET 105 like the gate signal 105*a*. Thus, the boost current 104B is allowed to pass through the boost coil 104 so as not to exceed the upper limit current $I_1$, whereby the boost current 104B is charged into the output side capacitor 107.

At a timing $t_4$ of the boost period $T_3$ in the Vb bias release period, the gate signal 108*a* is turned OFF and the gate signal 109*a* is turned ON. Thus, the output side capacitor voltage 100*a* reaches the voltage $V_3$ obtained by subtracting the battery voltage 1*a* from the target voltage $V_1$ at the opening of the injection valve, and the gate signal 105*a* is turned OFF.

When the output signal of the injector current 20B is long and the output side capacitor voltage 100*a* assumes the timing $t_{20}$ after having reached $V_3$, the gate signals 4*a* and 6*a* are turned OFF, and the injector current $I_3$ is charged into the output side capacitor 107 via a diode 8. Thus, the output side capacitor voltage 100*a* exceeds $V_3$ and reaches an overvoltage $V_3'$.

When a boost signal processing circuit 101 detects the overvoltage $V_3'$, the boost signal processing circuit 101 issues a command for overvoltage regulation to the boosting gate drive circuit 102. Then, the boosting gate drive circuit 102 supplies the gate signal 106*a* to the gate of an FET 106F during an overvoltage control period $T_{30}$. As a result, the output side capacitor voltage 100*a* is adjusted to $V_3$.

Even in the third embodiment, the charging energy becomes about 0.0612 [J] in a manner similar to the second embodiment. When the charging energy in the boost period $T_{21}$ is assumed to be about 0.0182 [J] upon charging from 60[V] to 61[V], and 0.0182 [J] is identically added to both the case of charging in the third embodiment and the case of charging not according to the present embodiment, the present embodiment enables an about 15% reduction in the charging energy as compared with other systems.

While the rate of reduction in the charging energy becomes smaller than that in the first embodiment in a manner similar to the second embodiment, the boost period $T_3$ in the Vb bias release period can be shortened as compared with the first embodiment due to the charging from the injector energization period.

In addition to the above, advantageous effects similar to those in the first embodiment can be obtained even in the third embodiment.

A boost voltage control system in the third embodiment will next be described.

Figure 10:
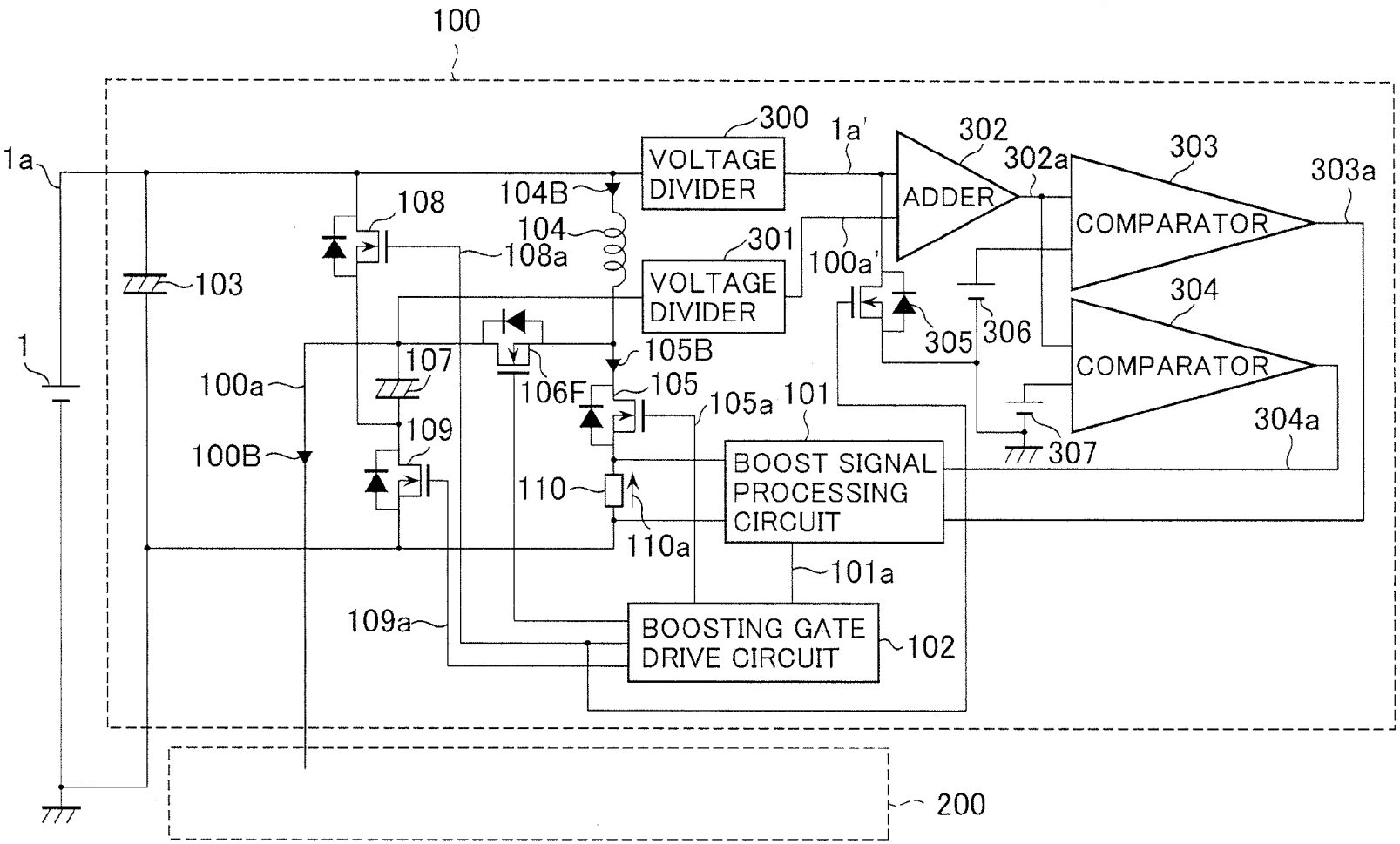
FIG. 10 is a circuit diagram of main parts of a boost signal processing circuit.
Figure 11:
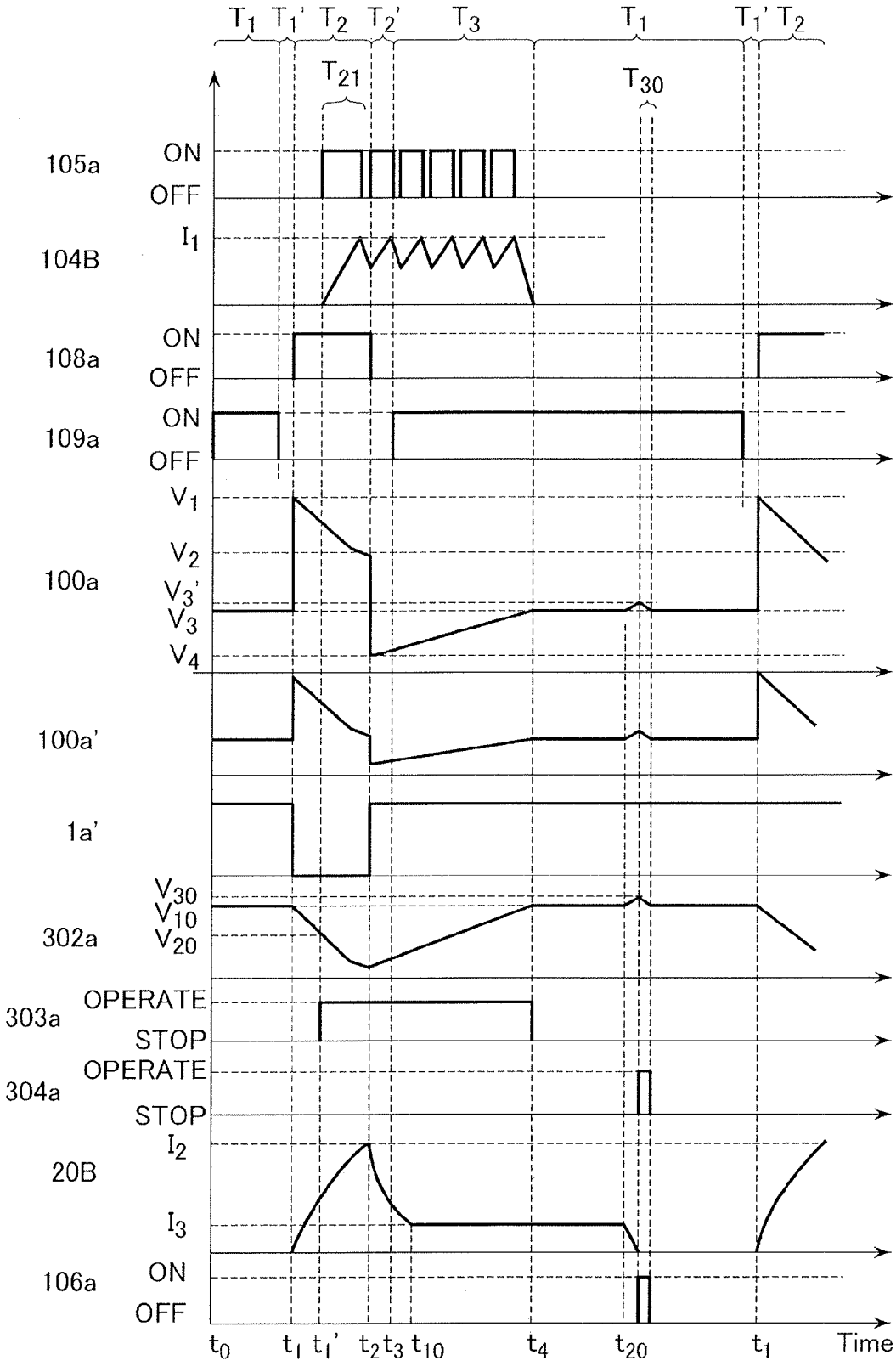
FIG. 11 is an explanatory diagram showing a signal waveform of a boost voltage control signal.

FIG. 10 is a circuit diagram showing main parts of the boost signal processing circuit employed in the third embodiment, and FIG. 11 is a signal waveform diagram for describing a boost voltage control signal.

In FIG. 10, a voltage divider 300 divides a battery voltage 1*a* to generate a divided battery voltage 1*a*', and inputs the divided battery voltage 1*a*' to an adder 302. A voltage divider 301 having the same division ratio as the voltage divider 300 divides an output side capacitor voltage 100*a* to generate a divided output side capacitor voltage 100*a*', and inputs the divided output side capacitor voltage 100*a*' to the adder 302. The adder 302 adds the input voltages 1*a*' and 100*a*' to provide an added signal 302*a*, and inputs the added signal 302*a* to both of comparators 303 and 304 each having a hysteresis, to which power supplies 306 and 307 different in reference signal are each coupled. The comparator 303 is used for control of a boosting operation, and the comparator 304 is used for control of a deboosting operation. The gate of an FET 305 shares a gate signal 108*a* of an FET 108.

Then, the operation of boost voltage control according to the third embodiment will be explained. FIG. 11 is a diagram showing waveforms of the divided battery voltage 1*a*', divided output side capacitor voltage 100*a*', added signal 302*a*, boost control signal 303*a*, deboost control signal 304*a*, gate signals 105*a*, 106*a*, 108*a* and 109*a*, boost coil current 104B, injector current 20B and output side capacitor voltage 100*a*.

First, it is assumed that a voltage obtained by dividing a target voltage $V_1$ at the opening of an injection valve at the same rate as the voltage dividers 300 and 301 is $V_{10}$, and is set as the voltage for the power supply 306. A voltage obtained by subtracting a hysteretic part from $V_{10}$ is assumed to be $V_{20}$. Then, a voltage obtained by dividing an overvoltage $V_3$' at the same rate as the voltage dividers 300 and 301 is assumed to be $V_{30}$ and set as the voltage for the power supply 307. A voltage obtained by subtracting a hysteretic part from $V_{30}$ is set to be $V_{10}$.

Since the added signal 302*a* exists between $V_{10}$ and $V_{20}$ at a timing $t_0$ of a Vb bias release period $T_1$, the gate signal 108*a* is turned OFF and the gate signal 109*a* is turned ON without performing the boosting operation. Thus, the output side capacitor voltage 100*a* is maintained at a voltage $V_3$ obtained by subtracting the battery voltage 1*a* from the target voltage $V_1$ at the opening of the injection valve.

During a battery short-circuit prevention period $T_1$', a boosting gate drive circuit 102 turns OFF the gate signals 108*a* and 109*a* to prevent a battery from being short-circuited.

At a timing $t_1$ of a Vb bias period $T_2$, the gate signal 108*a* is turned ON, the gate signal 109*a* is turned OFF and the negative pole of an output side capacitor 107 is biased by the battery voltage 1*a*. Therefore, the output side capacitor voltage 100*a* reaches the valve opening target voltage $V_1$ of the injection valve. At this time, the FET 305 that shares the gate signal 108*a* is also turned ON simultaneously to bring the divided battery voltage 1*a*' to 0V. Thus, even though Vb biasing is done, the added signal 302*a* remains unchanged and exists between $V_{10}$ and $V_{20}$, thereby the boosting operation is not executed.

When at a timing $t_1$' of the Vb bias period $T_2$, the injector current 20B flows, the output side capacitor voltage 100*a* is lowered and the added signal 302*a* becomes smaller than $V_{20}$, the boost control signal 303*a* assumes the boosting operation, so that the boosting operation is started. The boosting operation continues until the added signal 302*a* exceeds $V_{10}$.

When the injector current 20B reaches a valve opening current $I_2$ at a timing $t_2$ of the Vb bias period $T_2$, the injector current 20B is transitioned to a holding current $I_3$. The output side capacitor voltage 100*a* drops to $V_2$ due to energization to the injection valve.

During a battery short-circuit prevention period $T_2$', the boosting gate drive circuit 102 turns OFF the gate signals 108*a* and 109*a* to prevent the battery from being short-circuited. At this time, the FET 305 sharing the gate signal 108*a* is also turned OFF simultaneously, so that the divided battery voltage 1*a*' is returned from 0V to the original voltage.

At a timing $t_3$ of a boost period $T_3$ in a Vb bias release period, the gate signal 108*a* is turned OFF and the gate signal 109*a* is turned ON, so that the negative pole of the output side capacitor 107 is earthed. Thus, the output side capacitor voltage 100*a* drops to a voltage $V_4$ obtained by reducing the battery voltage 1*a*.

During the boost period $T_3$ in the Vb bias release period, the gate signal 108*a* is turned OFF and the gate signal 109*a* is turned ON, so that a PWM operation signal is applied to its corresponding FET 105 like the gate signal 105*a*. Thus, the boost current 104B is allowed to pass through the boost coil 104 so as not to exceed an upper limit current $I_1$, whereby the boost current 104B is charged into the output side capacitor 107.

At a timing $t_4$ of the boost period $T_3$ in the Vb bias release period, the gate signal 108*a* is turned OFF and the gate signal 109*a* is turned ON. Thus, the added signal 302*a* reaches $V_{10}$, the boost control signal 303*a* assumes a boosting operation stop and hence the gate signal 105*a* is turned OFF. At this time, the output side capacitor voltage 100*a* reaches the voltage $V_3$ obtained by subtracting the battery voltage 1*a* from the target voltage $V_1$ at the opening of the injection valve.

When the output signal of the injector current 20B is long and the output side capacitor voltage 100*a* assumes the timing $t_{20}$ after having reached $V_3$, the gate signals 4*a* and 6*a* are turned OFF, so that the injector current $I_3$ is charged into the output side capacitor 107 via the diode 8. Thus, the added signal 302*a* exceeds $V_{30}$. At this time, the output side capacitor voltage 100*a* exceeds $V_3$ and reaches an overvoltage $V_3$'.

The deboost control signal 304*a* assumes the deboosting operation, and the boosting gate drive circuit 102 supplies the gate signal 106*a* to the gate of an FET 106F during an overvoltage control period $T_{30}$. Thus, the deboosting operation is continued until the added signal 302*a* becomes $V_{10}$. At this time, the output side capacitor voltage 100*a* reaches $V_3$.

The boost voltage control system of the third embodiment is capable of obtaining a boost voltage that is targeted upon Vb biasing by using the adders even if the battery voltage and the output side capacitor voltage vary from each other.

While the preferred embodiments of the present invention have been described above, the present invention is not limited to the above embodiments. It should be noted that various modifications may be made to the embodiments within the scope based on the claims as appended.

Although, for example, the MOSFETs have been used as the switch elements in the examples described above, other switch elements (other transistors) may be used. In this case, the boosting gate drive circuit may be configured as a boosting base drive circuit (opening/closing command signal generating circuit).

What is claimed is:

1. An injector drive circuit comprising:

an input side capacitor to which a voltage of a battery is applied;

a boost coil having one end coupled to a positive pole of the input side capacitor;

a first switch element coupled to the other end of the boost coil;

a rectifying element coupled to the other end of the boost coil;

an output side capacitor coupled to the rectifying element;

a second switch element coupled to a positive pole of the output side capacitor;

an injection valve coupled to the second switch element;

a third switch element coupled between a negative pole of the output side capacitor and the positive pole of the input side capacitor;

a fourth switch element coupled between the negative pole of the output side capacitor and a negative pole of the input side capacitor;

a first opening/closing command signal generating unit for supplying an opening/closing command signal to the first switch element, the third switch element and the fourth switch element; and a second opening/closing command signal generating unit for supplying an opening/closing command signal to the second switch element, the first opening/closing command signal generating unit bringing the third switch element to a closed state and the fourth switch element to an open state during a period in which the second switch element is held in a closed state, the first opening/closing command signal generating unit bringing the third switch element to an open state and the fourth switch element to a closed state during at least part of a boost period of the output side capacitor.

2. The injector drive circuit according to claim 1, further comprising a boost signal processing circuit for detecting a voltage applied across the input side capacitor and a voltage applied across the output side capacitor, wherein the boost signal processing circuit supplies a boost signal to the first opening/closing command signal generating unit according to the voltage applied across the input side capacitor and the voltage applied across the output side capacitor, and wherein the first opening/closing command signal generating unit supplies the opening/closing command signal to the first switch element, the third switch element and the fourth switch element in accordance with the supplied boost signal.

3. The injector drive circuit according to claim 1, wherein the first opening/closing command signal generating unit has a function of preventing the third switch element and the fourth switch element from being brought to a closed state simultaneously.

4. The injector drive circuit according to claim 1, wherein the rectifying element is a MOS-FET having a body diode.

5. The injector drive circuit according to claim 4, wherein, when the voltage of the positive pole of the output side capacitor becomes greater than a predetermined voltage, the first opening/closing command signal generating unit supplies a gate signal to the rectifying element and reduces the voltage of the positive pole of the output side capacitor to the predetermined voltage.

6. The injector drive circuit according to claim 1, further comprising:

a first voltage divider coupled to one end corresponding to a positive pole of the battery;

a second voltage divider coupled to one end corresponding to the positive pole of the output side capacitor;

an adder having one end coupled to the other end of the first voltage divider and the other end of the second voltage divider;

a first comparator which has one end coupled to the other end of the adder and performs added-signal boosting; and a second comparator which has one end coupled to the other end of the adder and performs added-signal deboosting, wherein the adder outputs an added signal obtained by adding a first divided voltage outputted by the first voltage divider and a second divided voltage outputted by the second voltage divider, wherein the first comparator performs boosting based on a first reference value and the added signal, and wherein the second comparator performs deboosting based on a second reference value and the added signal.

* * * * *